US007869731B2

(12) United States Patent
Shakui

(10) Patent No.: US 7,869,731 B2
(45) Date of Patent: Jan. 11, 2011

(54) IMAGE FORMING APPARATUS WITH COLLECTION AMOUNT SETTING PORTION TO ENABLE A REDUCED COLLECTION AMOUNT TO BE SET FOR COLLECTION OF WASTE TONER PARTICLES

(75) Inventor: Toshimasa Shakui, Osaka (JP)

(73) Assignee: Kyocera Mita Corporation (JP)

( * ) Notice: Subject to any disclaimer, the term of this patent is extended or adjusted under 35 U.S.C. 154(b) by 590 days.

(21) Appl. No.: 11/711,281

(22) Filed: Feb. 27, 2007

(65) Prior Publication Data

US 2007/0201887 A1 Aug. 30, 2007

(30) Foreign Application Priority Data

Feb. 28, 2006 (JP) ..... 2006-052224

(51) Int. Cl.
*G03G 15/00* (2006.01)

(52) U.S. Cl. ..... 399/71; 399/35; 399/81; 399/358

(58) Field of Classification Search ..... 399/35, 399/43, 71, 81, 345, 358, 360
See application file for complete search history.

(56) References Cited

U.S. PATENT DOCUMENTS

| | | | | |
|---|---|---|---|---|
| 5,715,512 | A * | 2/1998 | Kumagai | |
| 6,029,025 | A * | 2/2000 | Sakakibara et al. | 399/71 |
| 6,181,886 | B1 * | 1/2001 | Hockey et al. | 399/35 |
| 6,738,587 | B1 * | 5/2004 | Hoene et al. | 399/77 |
| 7,120,366 | B2 * | 10/2006 | Onodera et al. | 399/35 |
| 2005/0185973 | A1 * | 8/2005 | Hama et al. | |
| 2006/0013601 | A1 * | 1/2006 | Stahuber | 399/35 |
| 2008/0008489 | A1 * | 1/2008 | Watanabe et al. | 399/71 |

FOREIGN PATENT DOCUMENTS

| | | |
|---|---|---|
| JP | 11-174917 | 7/1999 |
| JP | 2003-302882 | 10/2003 |
| JP | 2004-240369 | 8/2004 |
| JP | 2005-242274 | 9/2005 |
| JP | 2005-331611 | 12/2005 |

* cited by examiner

*Primary Examiner*—David P Porta
*Assistant Examiner*—Milton Gonzalez
(74) *Attorney, Agent, or Firm*—Gerald E. Hespos; Michael J. Porco

(57) ABSTRACT

An image forming apparatus includes: a photoconductive drum on which an electrostatic latent image is formed. A developer develops the electrostatic latent image to form a toner image on the photoconductive drum. A transfer-fixer transfers the toner image from the photoconductive drum to a recording sheet and fixes the toner image on the recording sheet. A waste toner particle collector collects toner particles remaining in the developing section into a collection container. A toner amount detector detects the amount of toner particles collected in the collection container. A notifying portion notifies a user when the amount of toner detected reaches a predetermined observing amount. A collection amount setting portion enables a reduced collection amount to be set for the collection of waste toner particles in the developing section in accordance with an increase in the detected toner amount after the detected toner amount reaches the observing amount.

9 Claims, 7 Drawing Sheets

1
2
200
201
202
203
204
205
208
300
301
302
303
400
401
402
403
404
405
406
407
408
409
500
501
503
100
101
102
103
104
105
106
107
108
110
111
112
113
114
20
21
23
-X
+X

IMAGE FORMING APPARATUS WITH COLLECTION AMOUNT SETTING PORTION TO ENABLE A REDUCED COLLECTION AMOUNT TO BE SET FOR COLLECTION OF WASTE TONER PARTICLES

BACKGROUND OF THE INVENTION

1. Field of the Invention

The present invention relates to an image forming apparatus which collects into a collection container waste toner particles generated by an operation of forming an image onto a recording sheet.

2. Description of the Related Art

Conventionally, an image forming apparatus adopting an electrophotographic method has been widely known. The image forming apparatus forms an image on a recording sheet by performing an exposing operation based on a image data to form an electrostatic latent image on a surface of a photoconductive drum uniformly charged with electricity, forming a toner image by a developing section adapted for developing the electrostatic latent image with toner particles, directly or indirectly transferring the toner image onto a recording sheet, and fixing the image on the recording sheet.

In this kind of image forming apparatus, toner particles generally remain on an image bearing member such as a photoconductive body or the like after the toner image transferring operation is performed. Therefore, a cleaning device is provided for removing the unneeded toner particles (hereinafter, referred to as waste toner particles). Further, a developability of toner particles which have not been used in the image forming operation and remained in a developing section for a long period of time is degraded. Accordingly, a printed image quality is also degraded. Therefore, the toner particles having a degraded developability or removed in the cleaning device (hereinafter, referred to as waste toner particles) are collected and stored in a detachable collection container (refer to Japanese Unexamined Patent Publication No. 2004-240369).

In such image forming apparatus, if an image forming operation is continued after the collection container is filled with waste toner particles, the waste toner particles overflow from the collection container. Therefore, when the amount of waste toner particles stored in the collection container is nearly full, the image forming apparatus warns a user that the collection container is full to induce the user to replace the collection container or suspend the image forming operation.

Meanwhile, even after warning that the collection container is nearly full, waste toner particles can be collected to some extent. Accordingly, there is a case where a user would like to continue an image forming operation to some extent. In the above-described image forming apparatus, there has been a disadvantage that the image forming operation is immediately suspended when the warning that the collection container is filled is given even though more waste toner particles can be collected to some extent. To continue the image forming operation to some extent even after the warning that the collection container is filled is given, while preventing the waste toner particles from overflowing, it may be so configured as to give the warning in a state where there is a great remaining volume of the collection container to be filled. However, in such case, if a user replaces the collection container immediately after the warning is given, it is assumed that the collection container is replaced while leaving a large space. Accordingly, there has been a disadvantage that a volume of the collection container cannot be utilized effectively.

SUMMARY OF THE INVENTION

The present invention was made to solve the problems described above, and its object is to provide an image forming apparatus capable of utilizing a volume of a collection container effectively and increasing the number of recording sheets to be formed with images after a warning that the collection container is nearly full is given.

Specifically, the present invention includes an image forming apparatus comprising: a photoconductive drum on which an electrostatic latent image is formed; a developing section for developing the electrostatic latent image to form a toner image on the photoconductive drum, a transfer-fixing section for transferring the toner image from the photoconductive drum to a recording sheet and fixing the toner image on the recording sheet; a waste toner particle collecting portion for collecting toner particles remaining in the developing section into a collection container; a toner amount detecting portion for detecting a toner amount of toner particles collected in the collection container; a notifying portion for notifying a user of a reach of a toner amount detected by the toner amount detecting portion to a predetermined observing amount; and a collection amount setting portion for setting a reduced collection amount for the collection of waste toner particles in the developing section by the waste toner collecting portion in accordance with an increase in the detected toner amount after the detected toner amount reaches the observing amount.

According to the aforementioned arrangement, an image is formed on a recording sheet by developing an electrostatic latent image formed on the photoconductive drum with toner particles to form a toner image, and transferring and fixing the toner image on the recording sheet. Then, the waste toner collecting portion collects the toner particles remaining in the developing section into the collection container. Further, the toner amount detecting portion detects a toner amount of toner particles collected in the collection container. When the toner amount reaches the predetermined observing toner amount, a predetermined message is notified by the notifying portion. After the toner amount detected by the toner amount detecting portion reaches the observing toner amount, the collection amount setting portion sets a reduced collection amount for the collection of waste toner particles in the developing section by the waste toner collecting portion in accordance with an increase in the detected toner amount, thereby increasing the numbers of images to be formed until the collection container is filled after the toner amount collected in the collection container increases and reaches the observing toner amount. Accordingly, without increasing a remaining volume of the collection container to be filled after the toner amount reaches the observing toner amount, a volume of the collection container is utilized effectively, thereby increasing the number of recording sheets to be formed with images after a message is notified to a user due to a reach of the waste toner amount to the observing toner amount.

These and other objects, features, and advantages of the present invention will become more apparent upon reading of the following detailed description along with the accompanied drawings.

DETAILED DESCRIPTION OF THE PREFERRED EMBODIMENTS

Figure 1:
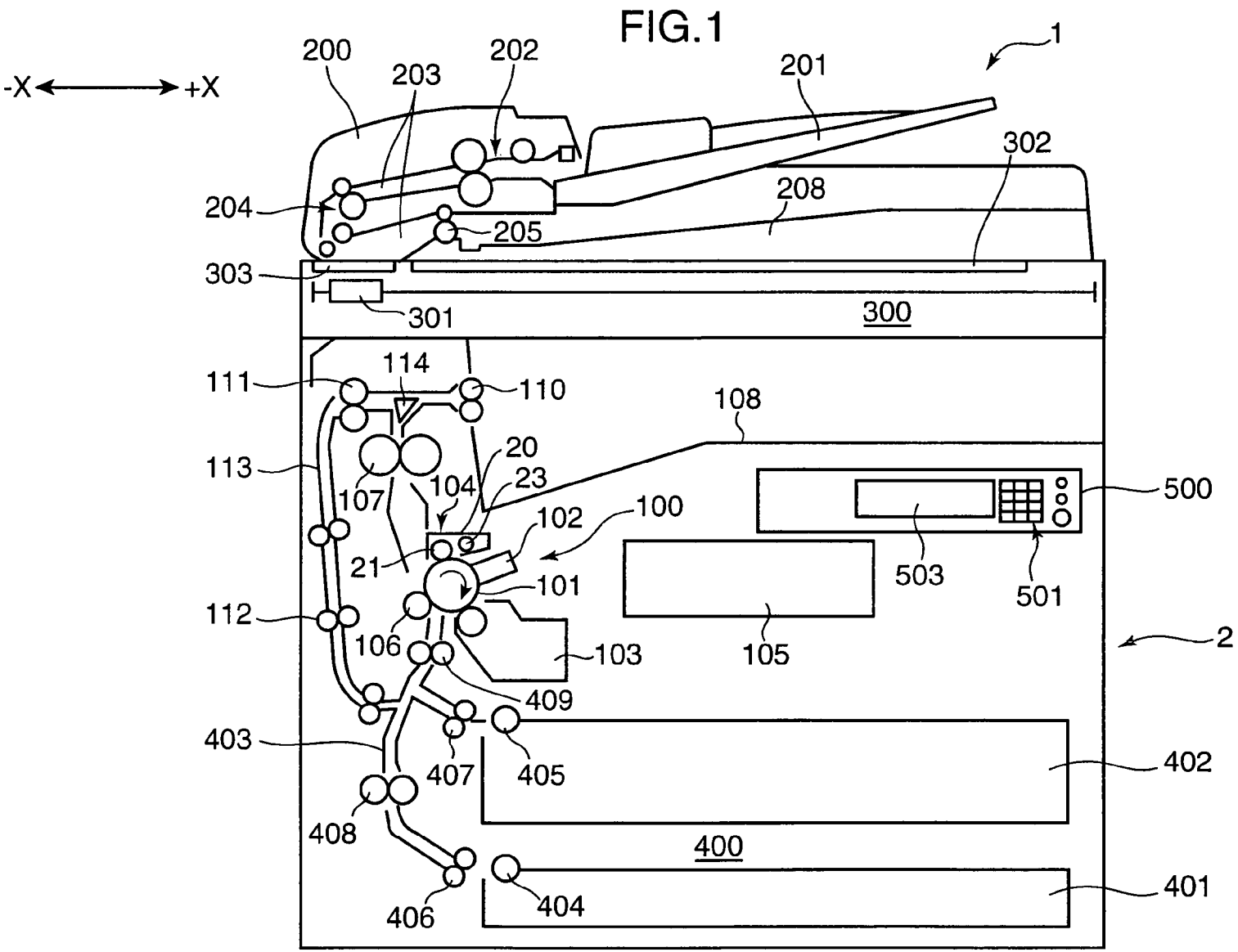
FIG. 1 is a schematic view mainly showing an internal configuration of a copying machine embodying an image forming apparatus according to the present invention.

Hereinafter, an embodiment of the present invention will be described with reference to the drawings. Components provided with the same reference numeral in respective drawings have the same configuration, and their description will be omitted. FIG. 1 is a schematic view mainly showing an internal configuration of a copying machine embodying an image forming apparatus according to the present invention. In the drawing, X-X directions show leftward and rightward directions, and Y-Y directions show forward and backward directions. Particularly, −X, +X, −Y and +Y directions respectively show leftward, rightward, forward and backward directions. In FIG. 1, a near side direction in the drawing sheet shows the −Y direction, and a depth direction shows the +Y direction.

A copying machine 1 shown in FIG. 1 includes an image forming section 100, a document feeding section 200, a document reading section 300, a sheet feeding section 400 and an operation display section 500 each provided in or on a housing 2 of a main body.

The document reading section 300 is adapted for reading a document and generating an image data corresponding to the document, and includes a scanner 301. The scanner 301 has a CCD (Charge Coupled Device) sensor, an exposure lamp and the like for generating an image data in accordance with an optically-acquired document image. On an upper surface of the document reading section 300, there are provided a first contact glass 302 for reading a manually-fed document, and a second contact glass 303 for reading a document fed through an ADF.

The document feeding section 200 (ADF) is adapted for feeding a document to the document reading section 300, and includes a document tray 201 for placing a document, a driving portion 202 having a conveying roller and the like for conveying the document from the document tray 201, a conveying roller 204 for conveying the document in a conveying passage 203, a discharging roller 205 for discharging the document conveyed by the conveying roller 204, a document discharging tray 208 for placing the document discharged by the discharging roller 205, and the like.

The sheet feeding section 400 is adapted for feeding a recording sheet to the image forming section 100, and includes sheet feeding cassettes 401, 402 each adapted for storing sheets (recording sheets) having a respective size and a conveying passage 403 for conveying a recording sheet from the sheet feeding cassettes to the image forming section 100. Each of the sheet feeding cassettes 401, 402 includes pickup rollers 404, 405 for taking out a stored recording sheet, and sheet feeding rollers 406, 407 for sending out the recording sheet one after another to a respective conveying passage. A conveying passage 403 is provided with a conveying roller 408 for conveying the recording sheet and a registration roller 409 for having the conveyed recording sheet wait before the image forming section 100.

The sheet feeding section 400 may be provided in one side (right side) of the housing 2 with a manual feeding portion (not shown) including a manual feeding tray or the like which can be opened and closed. In this case, the sheet conveying passage from the manual feeding portion is so configured as to merge on upstream from the registration roller 409.

The image forming section 100 is adapted for forming a image on a recording sheet conveyed from the sheet feeding section 400 and includes a photoconductive drum 101 supported rotatably in an arrow direction shown in FIG. 1, a charging portion 102, a developing section 103, a cleaning section 104, a laser-scanning unit 105 and a transferring roller 106 each provided along a peripheral surface of the photoconductive drum 101, and a fixing roller 107 provided on downstream from the transferring roller 106. In this case, the transferring roller 106 and the fixing roller 107 correspond to an example of a transfer-fixing section.

The charging portion 102 is adapted for uniformly charging the surface of the photoconductive drum 101 at a predetermined electric potential. The laser-scanning unit 105 is adapted for irradiating a laser beam to the surface of the photoconductive drum 101 based on the image data and forming an electrostatic latent image on the surface of the photoconductive drum 101.

Figure 2:
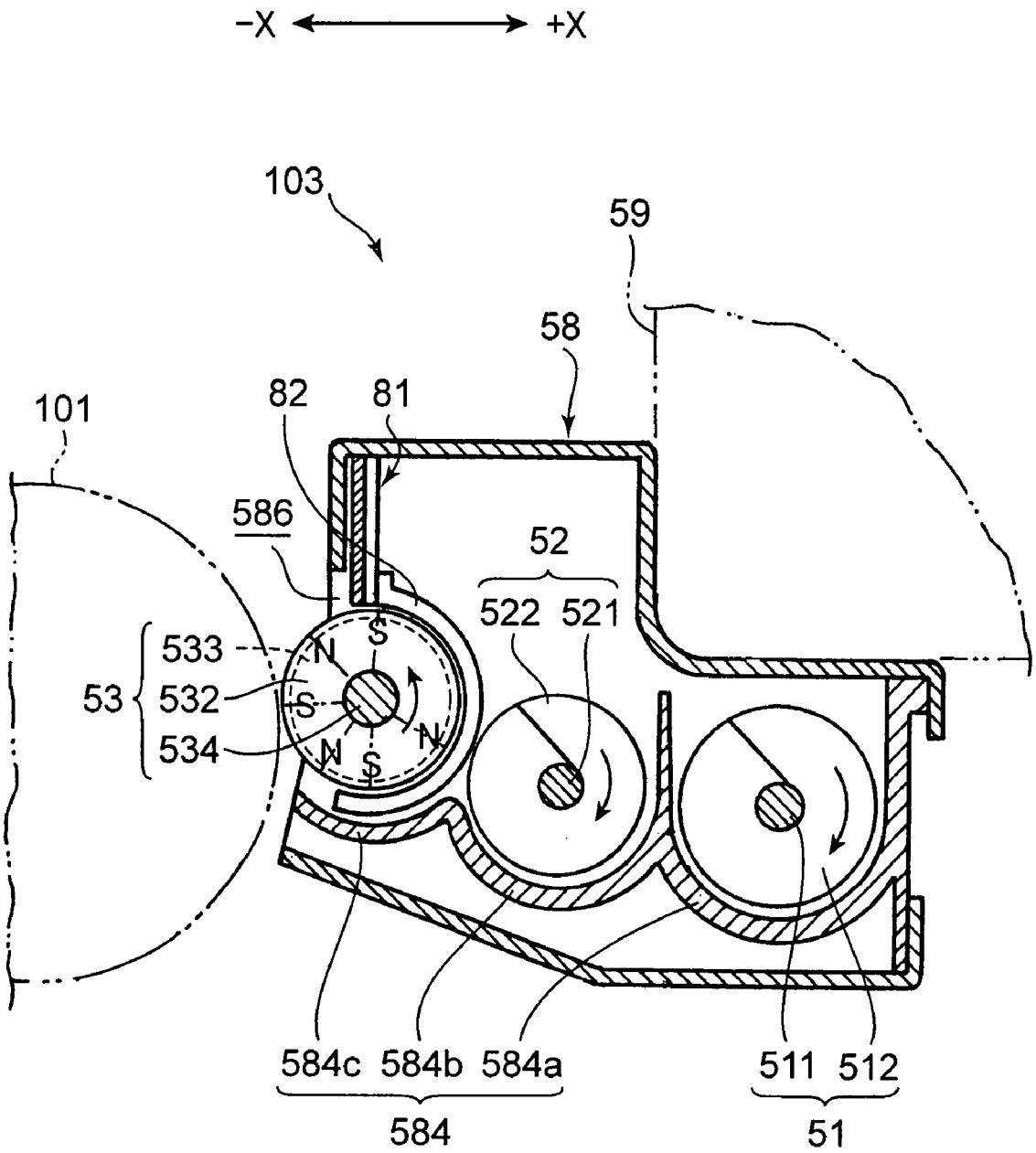
FIG. 2 is a sectional view showing an embodiment of a developing section shown in FIG. 1.

The developing section 103 is adapted for supplying toner particles to an electrostatic latent image and exposing an image. FIG. 2 is a sectional view showing an embodiment of the developing section 103. In FIG. 2, a near side direction in the drawing sheet shows the −Y direction, and a depth direction shows the +Y direction. In FIG. 2, the near side direction in the drawing sheet and the depth direction are respectively named front side and back side.

As shown in FIG. 2, the developing section 103 includes a box-like casing 58 provided therein with a first spiral feeder 51, a second spiral feeder 52 and a developing sleeve 53. The first spiral feeder 51 stirs and conveys toner particles supplied from a toner cartridge 59 toward the back side. The second spiral feeder 52 conveys the toner particles transferred from the first spiral feeder 51 toward the front side. The developing sleeve 53 receives the toner particles being conveyed by the second spiral feeder 52 and supplies the toner particles to a latent image area on the peripheral surface of the photoconductive drum 101.

Further, the developing section 103 includes a toner-receiving tray 584 for receiving toner particles supplied from the toner cartridge 59. The toner-receiving tray 584 has a first tray 584*a* for accommodating the first spiral feeder 51, a second tray 584*b* for accommodating the second spiral feeder 52 and a third tray 584*c* provided so as to face at its lower portion with the developing sleeve 53. The first to third trays 584*a*, 584*b*, 584*c* are formed to have an arc shape in a front view so as to correspond respectively to the first and second spiral feeders 51, 52 and the developing sleeve 53.

The first spiral feeder 51 has a first feeder shaft 511, and a first spiral fin 512 coaxially fixed to the first feeder shaft 511. The first spiral fin 512 is formed to be a counter-clockwise spiral. The first feeder shaft 511 is rotated in a clockwise direction in a front view so that the first spiral fin 512 conveys toner particles on the first tray 584*a* toward the back side.

The second spiral feeder 52 has a second feeder shaft 521, and a second spiral fin 522 coaxially fixed to the second feeder shaft 521. The second spiral fin 522 is formed to be a clockwise spiral. The second feeder shaft 521 is rotated in a clockwise direction in a front view so that the second spiral fin 522 conveys toner particles on the second tray 584*b* toward the front side.

The toner particles led into the casing 58 from the toner cartridge 59 are at first conveyed backward by a rotation of the first spiral feeder 51 on the first tray 584*a*, carried to the second tray 584*b* through an unillustrated backside communication hole and conveyed forward by a rotation of the second spiral feeder 52 on the second tray 584*b*. Thereafter, the toner particles are partially supplied to the developing sleeve 53 while circulating between the first and second trays 584*a*, 584*b*.

The developing sleeve 53 includes sleeve shaft cylinder 534, a sleeve main body 532 and a cylindrical sleeve magnet 533. The sleeve main body 532 has a hollow therein and is formed coaxially with the sleeve shaft cylinder 534. The sleeve magnet 533 is provided coaxially in the sleeve main body 532.

The developing sleeve 53 is positioned above a third tray 584*c* in such a manner that a peripheral surface of the sleeve main body 532 faces the peripheral surface of the photoconductive drum 101 through a toner-supplying opening 586. The developing sleeve 53 is rotated about a central shaft 534 in a counter-clockwise direction by an unillustrated driving motor. Accordingly, toner particles conveyed onto the third tray 584*c* are moved toward the peripheral surface of the photoconductive drum 101.

Further, there are provided a blade 81 and a pair of magnetic members 82 in the casing 58. The blade 81 is provided downwardly from a top panel of the casing 58 toward the peripheral surface of the sleeve main body 532 and extends in forward and backward directions. The pair of magnetic members 82 are provided on the right side of the sleeve main body 532 in such manner as to face front and back end portions of the sleeve main body 532. The blade 81 is adapted for restricting the amount of toner particles and preventing excessive supply of toner particles to an area on the peripheral surface of the photoconductive drum where an electrostatic latent image is formed by a rotation of the developing sleeve 53 about the sleeve shaft cylinder 534. A distance between a lower end of each magnetic member 82 and the peripheral surface of the developing sleeve 53 is set appropriately. The magnetic member 82 is adapted for preventing the toner particles from moving away from the peripheral surface of the sleeve main body 532 to which the toner particles are attached until they reach the blade 81 above the third tray 584*c* in the casing 58. The magnetic member 82 is formed to have an arc-shape in a front view.

In the developing section 103 configured as described above, toner particles attached and remained on the peripheral surface of the sleeve main body 532 are degraded. Thus, the toner particles remained on the peripheral surface of the developing section 103, in other words, waste toner particles are periodically attached to the peripheral surface of the photoconductive drum 101 in accordance with a control signal from a waste toner collection processing portion 604 and conveyed to the cleaning section 104 by the photoconductive drum 101. Then, the waste toner particles are collected into a collection container 30 by the cleaning section 104. In this case, the photoconductive drum 101 and the cleaning section 104, and the waste toner collection processing portion 604 for controlling operations of these correspond to an example of a waste toner collecting portion. Further, as a waste toner collecting portion, there may be provided a conveying mechanism for conveying waste toner particles remained on the peripheral surface of the developing section 103 directly to the collection container 30 without the photoconductive drum 101.

The transferring roller 106 presses a conveyed recording sheet onto the photoconductive drum 101 so as to transfer a toner image developed on the photoconductive drum 101 to the recording sheet. The fixing rollers 107 fix the transferred toner image on the recording sheet.

The fixing rollers 107 include a heating roller and a pressing roller. The heating roller melts toner particles on a recording sheet by heat, and the pressing roller applies a pressure, thereby fixing a toner image on the recording sheet.

The cleaning section 104 cleans untransferred toner particles (waste toner particles) remained on the surface of the photoconductive drum 101 after an image transfer to a recording sheet is terminated. As shown in FIG. 1, the cleaning section 104 includes a housing 20, a cleaning roller 21 and a spiral 23. The housing 20 is long in a backward direction on the drawing sheet. The cleaning roller 21 is adapted for cleaning the surface of the photoconductive drum 101. The spiral 23 is adapted for discharging the toner particles removed from the surface of the photoconductive drum 101 to outside of the image forming section. Further, on the front side the cleaning section 104 on the drawing sheet, there is replaceably provided the collection container 30 (FIG. 3) for storing the collected waste toner particles.

Hereinafter, the cleaning section 104 will be described in detail. The cleaning roller 21 is made of an elastic body such as a urethane foam and provided at a position facing the photoconductive drum 101. The cleaning roller 21 is provided in such a manner that it comes in frictionally-slidable contact with the surface of the photoconductive drum 101 on downstream from a position where a toner image is transferred (a position of facing the transferring roller 106). The cleaning roller 21 is rotatable in a rotational direction correspondingly to the rotational direction of the photoconductive drum 101 (arrow direction in FIG. 1). Further, there is provided an unillustrated cleaning blade made of a plate-like urethane rubber member or the like, and one end of the cleaning blade comes in frictionally-slidable contact with the photoconductive drum 101 on further downstream from the cleaning roller 21 so that toner particles remaining on the surface of the photoconductive drum 101 after the cleaning by the cleaning roller 21 are scraped off. The spiral 23 is formed with spiral-shaped fins around its rotational shaft, and is controlled to be rotated in a direction of discharging cleaning toner particles (waste toner particles) removed from the surface of the photoconductive drum 101 to the collection container 30 through the toner-discharging opening formed in a front-side plate of the cleaning device.

Figure 3:
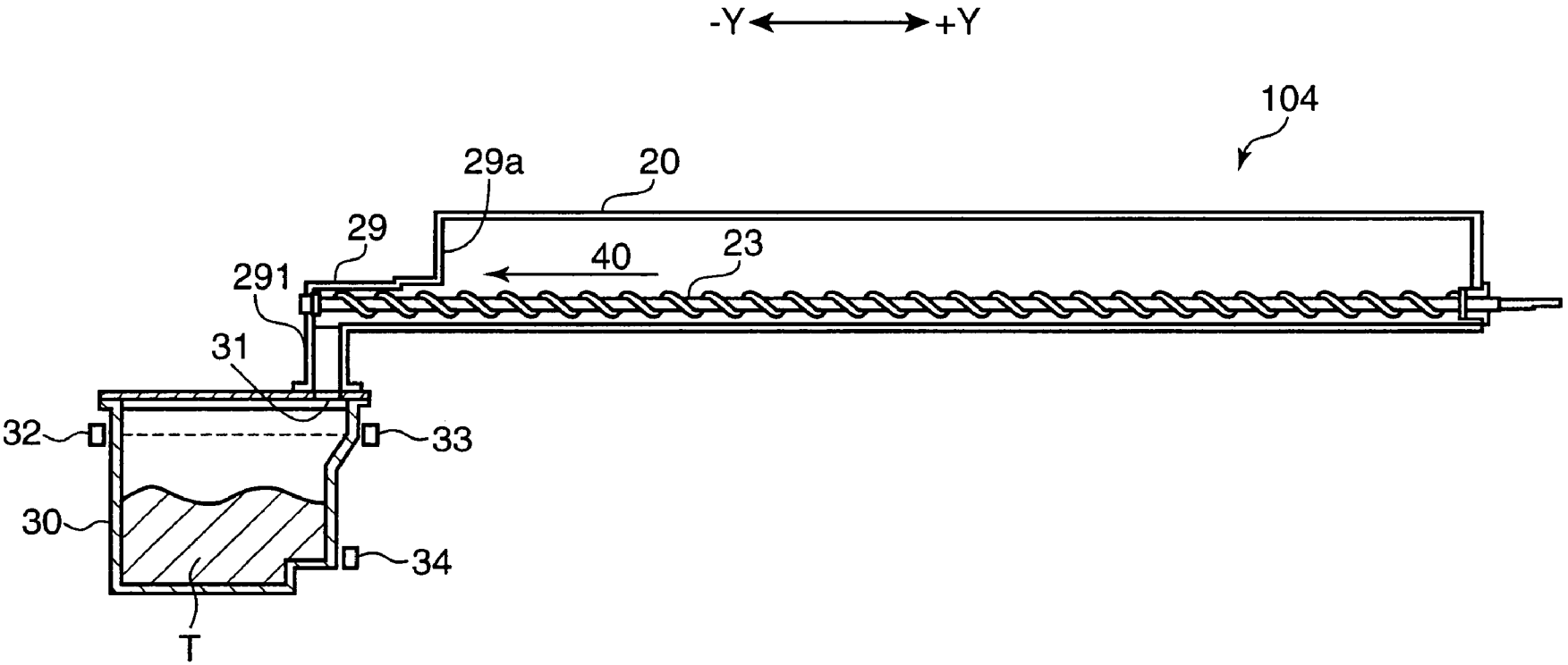
FIG. 3 is a sectional view showing an example of a configuration of a cleaning device and a collection container.

FIG. 3 is a sectional view showing an example of a configuration of the cleaning section 104 and the collection container 30. In FIG. 3, a waste toner reception hole 31 for collecting waste toner particles is formed on an upper surface of the substantially box-shaped collection container 30. The waste toner reception hole 31 communicates with a toner-discharging hole 291 through which waste toner particles in the housing 20 are discharged. According to the aforementioned configuration, waste toner particles T discharged from the cleaning section 104 can be collected into the collection container 30.

The waste toner particles T scraped from the photoconductive drum 101 are led to the waste toner discharging hole 291 by the spiral 23. Thus, the pitch and rotational direction of the spiral-shaped fins of the spiral 23 are determined in such a manner that the waste toner particles T are conveyed in a direction of an arrow 40, in other words toward the side of the collection container 30.

The collection container 30 is made of a substantially transparent resin material, for example. On opposite outer wall sides of the collection container 30, there are provided a light transmitter 32 and a light receiver 33 facing each other through the collection container 30. When the collection container 30 is nearly full, and toner particles T are collected in the collection container 30 to a position of leaving a predetermined remaining volume before being full, in other words, when the amount of toner particles contained in the collection container 30 reaches a predetermined observing toner amount, a light transmitted from the light transmitter 32 is interrupted by the toner particles T, and the light receiver 33 cannot receive the light. Accordingly, the light receiver 33 outputs a signal indicating that the amount of toner particles collected in the collection container 30 reaches the observing toner amount (light receiver 33 is turned OFF). In this case, the light transmitter 32 and the light receiver 33 correspond to an example of a toner amount setting portion.

Further, a collection container detecting switch 34 is provided in such manner as to come in contact with an outer wall of the collection container 30. When the collection container 30 is mounted on the cleaning section 104, the collection container detecting switch 34 is pressed and turned on by the collection container 30.

Referring back to FIG. 1, in an upper portion of the housing 2 of the main body, there is provided a sheet discharging tray 108 for stacking a discharged recording sheet. A recording sheet conveyed from the fixing roller 107 is discharged onto the sheet discharging tray 108 by a discharging roller 110. Switchings of conveying directions from the fixing roller 107 to the discharging roller 110 and from the discharging roller 110 to the conveying passage 113 (conveying rollers 111, 112) for reversing a recording sheet are performed by a branching guide 114.

The operation display section 500 is adapted for inputting predetermined instructions in accordance with an operation by a user, and is provided with an operation key portion 501 and a touch panel 503 (notifying portion, receiving portion). The operation key portion 501 includes key switches having a start key for allowing a user to input an instruction to perform printing and numerical keys for inputting the number of printings. The touch panel 503 displays operation guide information for inputting settings for various kinds of copying operations and various operation buttons.

Figure 4:
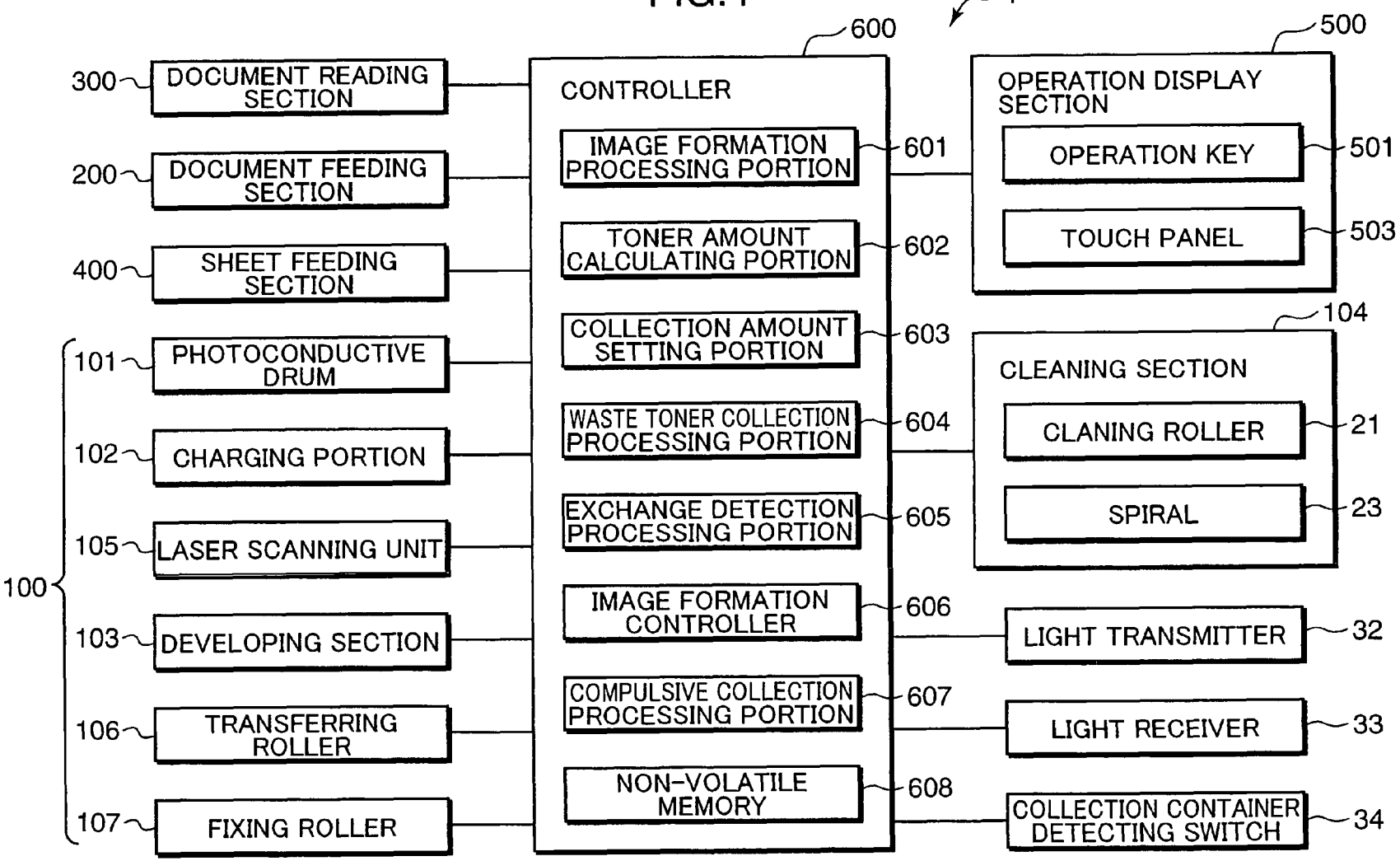
FIG. 4 is a block diagram showing an electric configuration of the copying machine shown in FIG. 1.

FIG. 4 is a block diagram showing an electric configuration of the copying machine 1 shown in FIG. 1. As shown in FIG. 4, the image forming section 100, the document feeding section 200, the document reading section 300, the sheet feeding section 400, the operation display section 500, the cleaning section 104, the light transmitter 32, the light receiver 33 and the collection container detecting switch 34 are connected to a controller 600 and operated in accordance with a control signals from the controller 600.

The controller 600 includes a CPU (Central Processing Unit), a ROM (Read Only Memory), a RAM (Random Access Memory), a non-volatile memory 608, peripheral circuits for these, and the like. The CPU performs a predetermined calculating processing. The ROM stores a predetermined control program. The RAM temporarily stores data. For example, the non-volatile memory 608 includes an EEPROM (Electrically Erasable and Programmable Read Only Memory) which is a non-volatile memory which can be rewritten.

The controller 600 performs the control program stored in the ROM so that it functions as an image formation processing portion 601, a toner amount calculating portion 602, a collection amount setting portion 603, a waste toner collection processing portion 604, an exchange detection processing portion 605 (emptiness detecting portion), an image formation controller 606 and a compulsive collection processing portion 607.

The image formation processing portion 601 controls relevant portions to make the image forming section 100 form an image read out in the document reading section 300 on a recording sheet conveyed from the sheet feeding section 400.

The toner amount calculating portion 602 calculates an amount of toner particles used for forming images on respective recording sheets by the image forming section 100 after the light receiver 33 outputs a detection signal indicating that the amount of toner particles collected in the collection container 30 reaches the observing toner amount (light receiver 33 is turned off). The calculation is performed based on the toner intensity of the image and the number of dots to be applied with toner particles among the total number of dots constituting the image data. Then, by adding the total amount of toner particles used for forming images on all of the recording sheets to the observing toner amount, the amount of toner particles collected after the reach of the observing toner amount is calculated. In this case, the light transmitter 32, the light receiver 33 and the toner amount calculating portion 602 corresponds to an example of the toner amount detecting portion.

Accordingly, the amount of toner particles collected in the collection container 30 after a reach of the observing toner amount of the collection container 30 can be calculated just by providing the light transmitter 32 and the light receiver 33 at positions for detecting the observing toner amount. Accordingly, there is no need to provide a separate sensor for detecting the toner amount until the collection container 30 is filled after a reach of the observing toner amount. Thus, a cost for a toner amount detecting portion can be reduced.

The collection amount setting portion 603 sets a reduced amount for collecting the waste toner particles in the developing section 103 by the waste toner collection portion 604 in accordance with an increase in the toner amount after the toner amount detected by the light transmitter 32 and the light receiver 33 or the toner amount calculated by the toner amount calculating portion 602 reaches the observing toner amount predetermined for the respective toner amounts.

The waste toner collection processing portion 604 controls the spiral 23 to be rotationally driven so as to collect into the collection container 30 toner particles removed from the surface of the photoconductive drum 101 by the cleaning roller 21 and the unillustrated cleaning blade when the image forming section 100 performs an operation of forming an image onto a recording sheet. Further, the waste toner collection processing portion 604 determines waste toner particles remained in the developing section 103 of the developing section 103 periodically, for example, at each time when the number of recording sheets to be formed with images reaches the predetermined number. Then, the waste toner particles are conveyed to the cleaning section 104 by a rotation of the photoconductive drum 101. Accordingly, the waste toner particles removed from the surface of the photoconductive drum 101 by the cleaning section 104 are collected into the collection container 30.

The exchange detection processing portion 605 determines that the collection container 30 is replaced and became substantially empty when the collection container 30 is detached from the cleaning section 104 and the collection container detecting switch 34 is turned off, and thereafter the collection container 30 is mounted to the cleaning section 104 and the collection container detecting switch 34 is turned on. It should be noted that the wording "substantially empty" includes a state close to empty. For example, the exchange detection processing portion 605 may include a light transmitting device and a light receiving device having the same construction as of the light transmitter 32 and the light receiver 33 and detect that the collection container 30 is empty when the waste toner amount in the collection container 30 is nearly empty and is lower than a predetermined remaining toner amount.

The exchange detection processing portion 605 is described above as an example of an emptiness detecting portion which determines that waste toner particles collected in the collection container 30 becomes substantially empty by detecting the exchange of the collection container 30. However, the collection container 30 is not limited to the one which is replaceable but may be so configured that waste toner particles can be discharged by opening a lower cap of the container and the light transmitting device and the light device may be provided in a lower portion of the container to detect that the collection container 30 became substantially empty.

The image formation controller 606 restricts an image forming operation until the exchange detection processing portion 605 determines that the collection container 30 is replaced when the toner amount calculating portion 602 calculates that waste toner particles in the collection container 30 are full.

When the exchange detection processing portion 605 detects that the collection container 30 is replaced in a state where the collection amount setting portion 603 sets a reduced collection amount for toner particles, the compulsive collection processing portion 607 controls the waste toner collection processing portion 604 to perform a compulsive collecting operation for collecting toner particles remained in the developing section 103 into the collection container 30.

Figure 5:
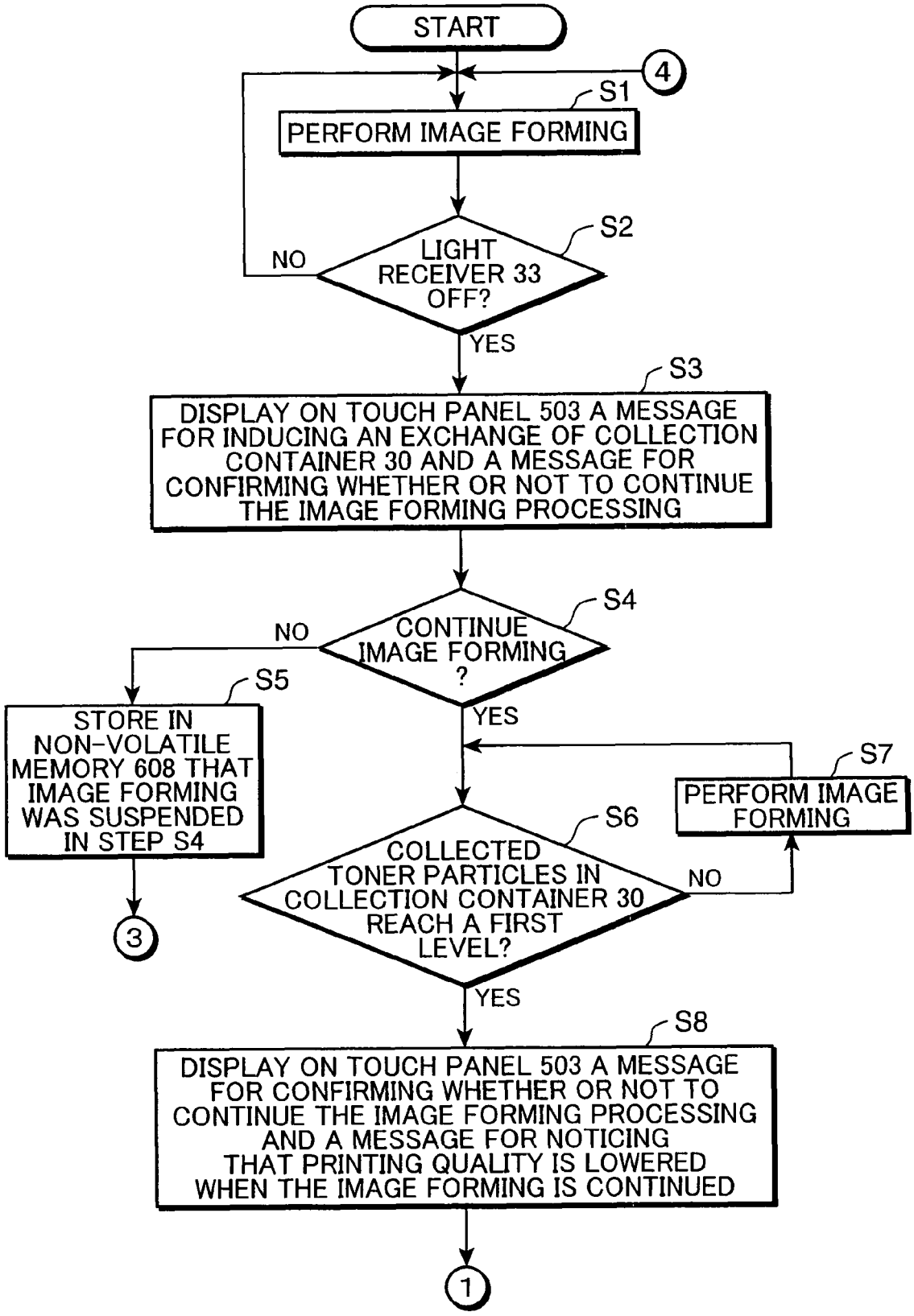
FIG. 5 is a flowchart showing an example of an operation of the copying machine shown in FIG. 4.
Figure 6:
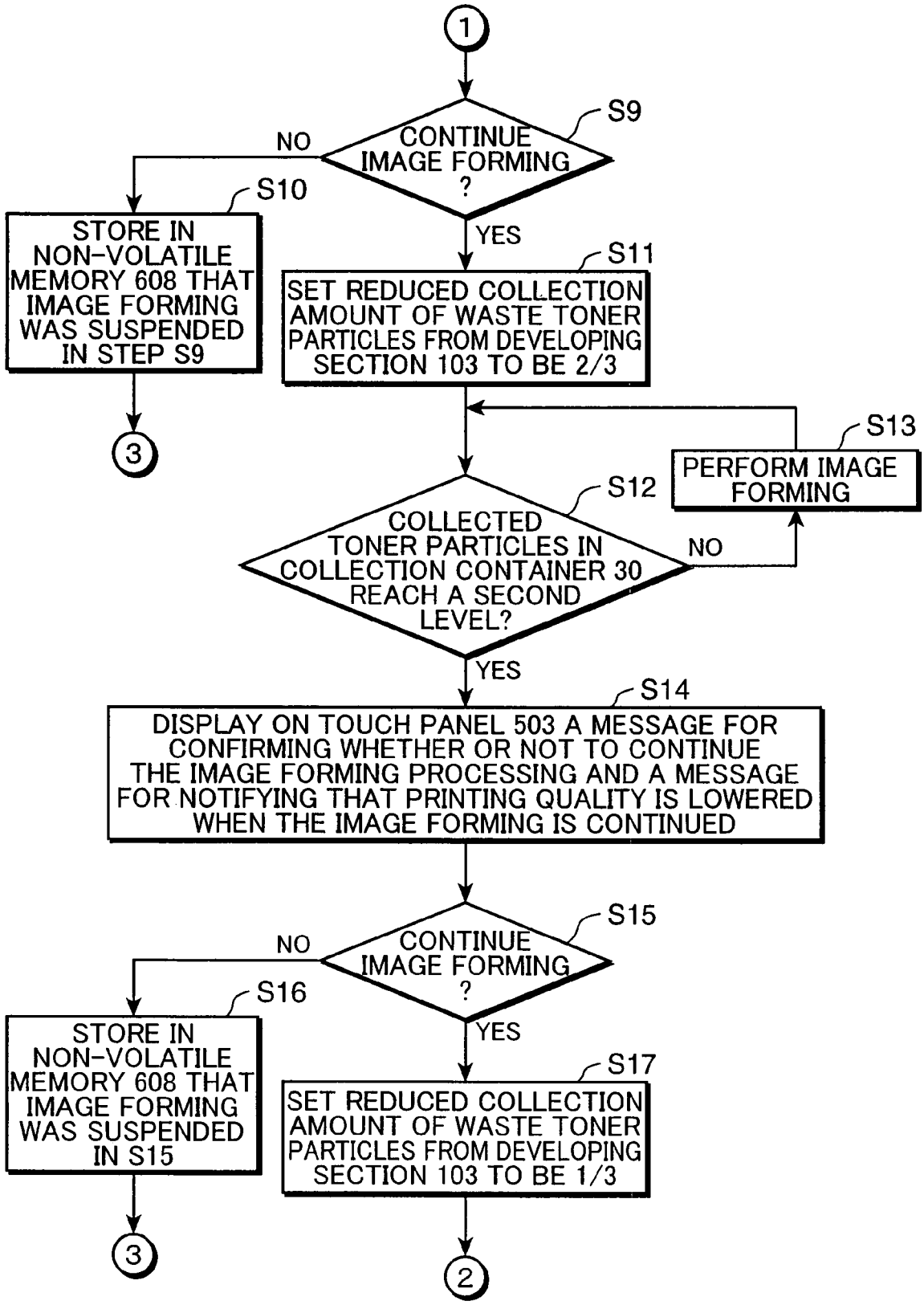
FIG. 6 is a flowchart showing an example of an operation of the copying machine shown in FIG. 4.
Figure 7:
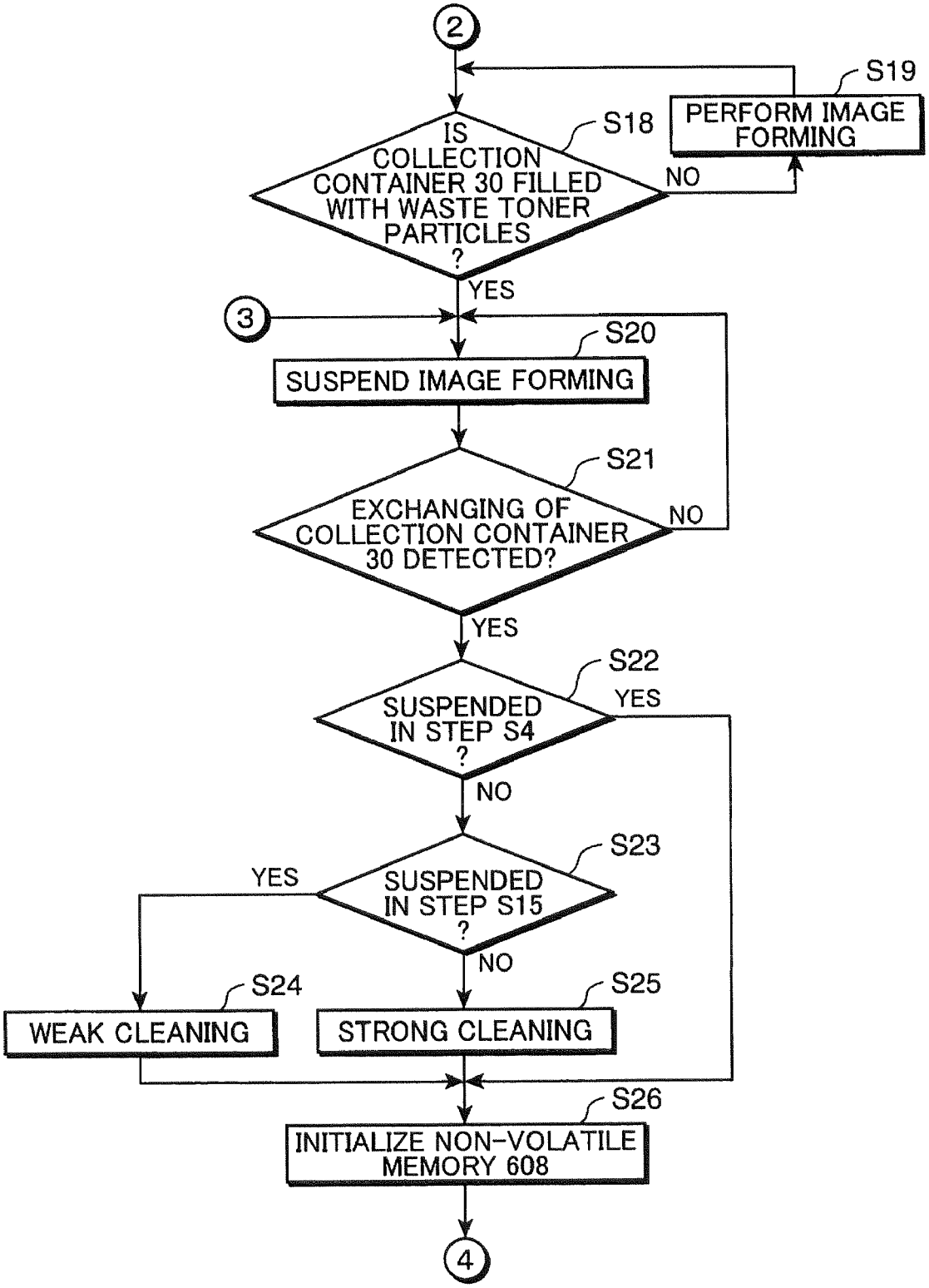
FIG. 7 is a flowchart showing an example of an operation of the copying machine shown in FIG. 4.

Hereinafter, an operation of the copying machine 1 as configured above will be described. FIGS. 5, 6, 7 are flowcharts showing an example of an operation of the copying machine 1 shown in FIG. 4. At first, in Step S1, the charging portion 102 charges the surface of the photoconductive drum 101 with electricity based on a control signal from the image formation processing portion 601. Then, the laser scanning unit 105 forms an electrostatic latent image on the surface of the photoconductive drum 101 based on an image data read out from a document by the scanner 301. Then, the developing section 103 develops electrostatic latent image to form a toner image, and the transferring roller 106 transfers the toner image to a recording sheet conveyed by the sheet feeding section 400. Further, the toner image transferred to the recording sheet is pressed and fixed on the recording sheet by the fixing roller 107. At this time, waste toner particles remaining on the surface of the photoconductive drum 101 are removed by the cleaning roller 21 and unillustrated cleaning blade and collected into the collection container 30 by the spiral 23.

Then, the image formation processing portion 601 confirms ON/OFF state of the light receiving device 33. When the light receiving device 33 is ON (NO in Step S2), there is enough space in the collection container 30. Accordingly, the routine goes back to Step S1 again, and an image forming processing is performed. On the other hand, when the light receiving device 33 is OFF (Yes in Step S2), the amount of toner stored in the collection container 30 reaches the observing toner amount which is nearly full. Accordingly, the routine proceeds to Step S3 to induce a user to replace the collection container 30.

In Step S3, in accordance with a control signal from the image formation processing portion 601, the touch panel 503 displays a message for inducing a user to replace the collection container 30 and a message for confirming whether or not to continue an image forming processing (Step S3). Then, when the touch panel 503 receives an operative instruction from a user to not to continue the image forming processing (NO in Step S4), the image formation processing portion 601 stores in the non-volatile memory 608 that an image forming processing is suspended in Step S4 (Step S5), and the routine proceeds to S20 to restrict the image forming processing. It may be so configured that the non-volatile memory 608 stores various information such as a calculated value of the amount of toner particles accumulated until the collection container 30 overflows, and a processing step being executed.

On the other hand, when the touch panel 503 receives an operative instruction from a user to continue an image formation processing (YES in Step S4), the collection amount setting portion 603 confirms amount of toner particles collected in the collection container 30 which is calculated by the toner amount calculating portion 602 (Step S6). If the collection toner amount does not reach a predetermined first level of toner amount which is set to be greater than the observing toner amount (NO in Step S6), an image forming is performed like the Step S1 (Step S7), and the Step S6 is repeated again. On the other hand, if the collection toner amount reaches the first level (YES in Step S6), the routine proceeds to Step S8. In this case, for example, the first level is a toner amount calculated by adding to the observing toner amount an amount of toner particles which is one-third of the volume to fill the collection container 30 from the observing toner amount.

Next, in Step S8, in accordance with a control signal from the image formation processing portion 601, the touch panel 503 displays a message for confirming whether or not to continue an image forming processing and a message for notifying that a printed image quality is degraded in a case where the image forming processing is continued. Then, when the touch panel 503 receives from a user an operative instruction to not to continue the image forming processing (NO in Step S9), the image formation processing portion 601 stores in the non-volatile memory 608 that the image forming was suspended in Step S9 (Step S10). Then, the routine proceeds to Step S20 to suspend the image forming processing.

On the other hand, when the touch panel 503 receives from a user an operative instruction to continue the image forming processing (YES in Step S9), the collection amount setting portion 603 sets a reduced amount of waste toner particles collected periodically from the developing section 103 into the collection container 30 by the waste toner collection processing portion 604. For example, the reduced amount is set to be ⅔ of a collection amount in the normal state (Step S11).

Accordingly, since the collection amount of waste toner particles collected into the collection container 30 is reduced, the number of recording sheets to be formed with images until the collection container 30 is filled after the message for inducing a user to replace the collection container 30 is given is increased. Further, since the number of recording sheets to be formed with images until the collection container 30 is filled is increased by reducing the collection amount of waste toner particles collected into the collection container 30, a volume of the collection container 30 can be utilized more effectively than in the case where the number of recording sheets to be formed with images after the notification is given is increased by increasing a remaining volume of the collection container 30 at the time of notification. There will be a likelihood that a printed image quality is degraded if the collection amount of waste toner particles collected into the collection container 30 is reduced. However, a user may select between continuing the image forming while degrading a printed image quality or suspending the image forming and exchanging the collection container 30. Accordingly, a convenience can be improved in accordance with a user's need.

Next, the collection amount setting portion 603 confirms the collection amount of toner particles collected in the collection container 30 which is calculated by the toner amount calculating portion 602 (Step S12). If the collection toner amount does not reach a second level predetermined to be an amount greater than the first level (NO in Step S12), an image forming is performed like in Step S1 (Step S13) and the Step S12 is repeated again. On the other hand, if the collection toner amount reaches the second level (YES in Step S12), the routine proceeds to Step S14. In this case, the second level indicates a toner amount calculated by adding ⅔ of the volume to fill the collection container 30 from the observing toner amount.

Next, in Step S14, in accordance with a control signal from an image formation processing portion 601, the touch panel 503 displays a message for confirming whether or not to continue an image forming processing and a message for notifying that a printed image quality is degraded if when an image forming is continued. When the touch panel 503 receives from a user an operative instruction to not to continue the image forming processing (NO in Step S15), the image formation processing portion 601 stores in the non-volatile memory 608 that the image forming was suspended in Step S15 (Step S16). Then, the routine proceeds to Step S20 to suspend the image forming processing.

On the other hand, when the touch panel 503 receives from a user an operative instruction to continue the image forming processing (YES in Step S15), the collection amount setting portion 603 sets a further reduced collection amount of toner particles collected periodically from the developing section 103 to the collection container 30 by the waste toner collection processing portion 604 (Step S17). For example, the further reduced amount is ⅓ of an amount in the normal state.

Accordingly, the collection amount of waste toner particles collected into the collection container 30 is reduced in accordance with an increase in amount of toner particles collected in the collection container 30. Therefore, the number of recording sheets to be formed with images until the collection container 30 is filled after the notification by a message for inducing a user to replace the collection container 30 can be further increased.

When the collection amount setting portion 603 confirms the amount of toner particles collected into the collection container 30 which is calculated by the toner amount calculating portion 602 (Step S18), and the collection toner amount does not reach a full amount of the collection container 30 (NO in Step S18), the image forming is continued like the Step S1 (Step S19), and the Step S18 is repeated again. When the collection toner amount reaches the full state (YES in Step S18), the routine proceeds to Step S20.

In Step S20, the image formation controller 606 restricts an image forming operation performed by the image forming section 100, and the image forming operation is suspended. When the exchange detection processing portion 605 detects turning off of the collection container detecting switch 34 due to a detachment of the collection container 30 from the cleaning section 104, and thereafter detects turning on of the collection container 30 detecting switch 34 according to mounting of the collection container 30 to the cleaning section 104, and determines that the collection container 30 is replaced (YES in Step S21), the compulsive collection processing portion 607 refers to the non-volatile memory 608. Further, in the case where it is stored in the non-volatile memory 608 that the image forming was suspended in Step S4 (YES in Step S22), the collection amount setting portion 603 has not yet set a reduced collection amount of toner particles. Accordingly, the routine proceeds to Step S26 without performing a compulsive collection operation by the compulsive collection processing portion 607.

On the other hand, when the compulsive collection processing portion 607 refers to the non-volatile memory 608, and the it is stored in the non-volatile memory 608 that the image forming was suspended in Step S4 (YES in Step S22), the collection amount of waste toner particles periodically collected from the developing section 103 to the collection container 30 by the waste toner collection processing portion 604 is not reduced. Accordingly, the routine proceeds to Step S26 without performing the compulsive collection operation.

Further, in Step S4, when it is not stored in the non-volatile memory 608 that the image forming was suspended in Step S4 (NO in Step S22), but it is stored in the non-volatile memory 608 that the image forming was suspended in Step S15 (YES in Step S23), the collection amount of waste toner particles periodically collected from the developing section 103 to the collection container 30 by the waste toner collection processing portion 604 is reduced to be ⅔. Accordingly, there is a likelihood that the amount of waste toner particles remained in the developing section is increased. Therefore, in accordance with a control signal from the compulsive collection processing portion 607, waste toner particles remained in the developing section 103 are attached to the peripheral surface of the photoconductive drum 101, and the waste toner particles are conveyed to the cleaning section 104 by a rotation of the photoconductive drum 101. Accordingly, the cleaning section 104 performs a compulsive collecting operation for collecting waste toner particles removed from the surface of the photoconductive drum 101 into the collection container 30.

In this case, a collection amount of waste toner particles periodically collected from the developing section 103 to the collection container 30 by the waste toner collection processing portion 604 is set to be ⅔, and it has a greater collection amount of waste toner particles than in the case where the collection amount of waste toner particles periodically collected from the developing section 103 to the collection container 30 without suspending in Step S15 is reduced to be ⅓. Accordingly, the collection amount of waste toner particles according to the above-described compulsive collection operation is set to be the first collection amount which is set to be smaller than the case where the compulsive collection processing portion 607 reduces the periodical collection amount of waste toner particles to be ⅓. Accordingly, a weak cleaning is performed (Step S24).

On the other hand, in a case where it is not stored in the non-volatile memory 608 that the image forming was suspended in Step S15 (NO in Step S23), the collection amount of waste toner particles periodically collected from the developing section 103 to the collection container 30 by the waste toner collection processing portion 604 is reduced to ⅓. Accordingly, there is a likelihood that the amount of waste toner particles remained in the developing section 103 is further increased. Therefore, in accordance with a control signal from the compulsive collection processing portion 607, waste toner particles remained in the developing section 103 are attached to the peripheral surface of the photoconductive drum 101 by the image forming portion 601. At this time, the photoconductive drum 101 is rotated, and the waste toner particles on the peripheral surface of the photoconductive drum 101 are conveyed to the cleaning section 104. The waste toner particles on the peripheral surface of the photoconductive drum 101 are removed from the surface of the photoconductive drum 101 by the cleaning section 104 and collected into the collection container 30 (compulsive collection operation).

In this case, since a collection amount of waste toner particles periodically collected from the developing section 103 to the collection container 30 by the waste toner collection processing portion 604 is set to be ⅓, it is smaller than in the case where the collection amount of waste toner particles periodically collected from the developing section 103 to the collection container 30 after the image forming is suspended in Step S15 is reduced to ⅔. Accordingly, the compulsive collection processing portion 607 performs a strong cleaning where the collection amount of waste toner particles collected by the above-described compulsive collecting operation is set to be a second collection amount which is greater than the first collection amount (Step S25).

In other words, in the case where the compulsive collection processing portion 607 controls the waste toner collecting portion to perform the compulsive collection operation, the collection amount of toner particles remained in the developing section 103 to the collection container 30 is increased in accordance with a reduction of collection amount of toner particles by the collection amount setting portion 603 at the time when the exchange detection processing portion 605 detects that the collection container 30 is exchanged. Accordingly, in a case where the number of recording sheets to be formed with images until the collection container 30 is filled is increased by reducing the collection amount of waste toner particles to the collection container 30, the waste toner particles in the developing section 103 which are increased by reduction of the collection amount of waste toner particles are compulsively collected into the collection container 30 after the collection container 30 is replaced. Since the amount of waste toner particles collected in accordance with increase or decrease in the amount of waste toner particles remaining in the developing section 103 can be increased or decreased, a quality of image forming after replacing the collection container 30 can be improved.

Next, in Step S26, after the image formation controller 606 releases restriction of image forming, and the stored content of the non-volatile memory 608 is initialized (Step S26), the routine proceeds to Step S1 again, and the image forming is performed.

Specifically, an image forming apparatus according to the present invention comprises: a photoconductive drum on which an electrostatic latent image is formed; a developing section for developing the electrostatic latent image to form a toner image on the photoconductive drum, a transfer-fixing section for transferring the toner image from the photoconductive drum to a recording sheet and fixing the toner image on the recording sheet; a waste toner particle collecting portion for collecting toner particles remaining in the developing section into a collection container; a toner amount detecting portion for detecting a toner amount of toner particles collected in the collection container; a notifying portion for notifying a user of a reach of a toner amount detected by the toner amount detecting portion to a predetermined observing amount; and a collection amount setting portion for setting a reduced collection amount for the collection of waste toner particles in the developing section by the waste toner collecting portion in accordance with an increase in the detected toner amount after the detected toner amount reaches the observing amount.

Further, according to the present invention, the notifying portion notifies a user that a quality of image forming by the photoconductive drum, the developing section and the transfer-fixing section is degraded.

According to the aforementioned arrangement, an electrostatic latent image formed on the photoconductive drum is developed with toner particles to form a toner image, and the toner image is transferred and fixed on a recording sheet so that an image is formed on the recording sheet. Then, the waste toner particle collecting portion collects toner particles remained in the developing section into the collection container. Further, the toner amount detecting portion detects a toner amount of toner particles collected in the collection container, and the notifying portion notifies a user of a reach of a toner amount detected by the toner amount detecting portion to a predetermined observing amount. When a toner amount detected by the toner amount detecting portion reaches the observing toner amount, the collection amount setting portion sets a reduced collection amount for the collection of waste toner particles in the developing section by the waste toner collecting portion in accordance with an increase in the detected toner amount after the detected toner amount reaches the observing amount. After the amount of toner particles collected in the collection container increases and reaches the observing toner amount, the number of recording sheets to be formed with images until the collection container is filled is increased. Accordingly, a volume of the collection container is utilized effectively without increasing the remaining amount of the collection container after the amount of toner particles collected in the collection container until a reach of the observing toner amount, and the number of sheets to be formed with images after a user is notified due to a reach of the amount of waste toner particles to the observing toner amount.

Further, according to the present invention, the notifying portion notifies a user to input an instruction of whether or not continuing an image forming operation performed by the photoconductive drum, the developing section and the transfer-fixing section. Further, the image forming apparatus further comprises: a receiving portion for receiving an operative instruction of whether or not performing the image forming operation when the notifying portion notifies a reach of the toner amount detected by the toner amount detection portion to the predetermined observing amount; and an image formation controller for controlling the photoconductive drum, the developing section and the transfer-fixing portion to continue the image forming operation when the receiving portion receives the instruction to perform the image forming operation.

Further, according to the present invention, the notifying portion notifies a user to input an instruction of whether or not continuing image forming operation performed by the photoconductive drum, the developing section and the transfer-fixing section, and also notifies that a quality of the image to be formed is degraded.

According to the aforementioned arrangements, in a case where a toner amount detected by the toner amount detecting portion reaches the predetermined observing toner amount, and the receiving portion receives an operative instruction to perform an image forming operation, an image forming operation is continued by the image formation controller. Accordingly, after confirming the message, a user can select whether degrading a quality of a printed image and continuing an image forming or suspending an image forming.

Further, according to the present invention, the image forming apparatus further comprises an emptiness detecting portion for detecting that the collection container is substantially empty. When the receiving portion receives an operative instruction of not performing the image forming operation, the image formation controller restricts the image forming operation until the emptiness detecting portion detects that the collection container is substantially empty.

According to the aforementioned arrangement, when the receiving portion receives an operative instruction of not performing the image forming operation, the image formation controller restricts the image forming operation until the emptiness detecting portion detects that the collection container is substantially empty. Accordingly, a user can select a user can select whether degrading a quality of a printed image and continuing an image forming or suspending an image forming and making the collection container empty so that a convenience can be improved in accordance with a user's need.

Further, according to the present invention, the image forming apparatus further comprises: the emptiness detecting portion for detecting that the collection container is substantially empty; and a compulsive collection processing portion for controlling the waste toner particle collecting portion to collect toner particles remaining in the developing section into the collection container when the emptiness detecting portion detects that the collection container is substantially empty in a state where the collection amount setting portion sets a reduced collection amount for the collection of waste toner particles.

According to the aforementioned arrangement, even in a case where there is a likelihood that the amount of waste toner particles remaining in the developing section has increased by a control of the collection amount setting portion to reduce a collection amount of toner particles, the waste toner particles remaining in the developing section are collected into the collection container by the compulsive collection processing portion. Accordingly, after the collection container becomes substantially empty, a deterioration of a printed image quality due to a deterioration of a developability of waste toner particles in the developing section can be suppressed.

Further, according to the present invention, when the waste toner particles collecting portion performs the compulsive collection operation, the compulsive collection processing portion increases the collection amount of waste toner particles in the developing section in accordance with a decrease in the collection amount of the toner particles by the collection amount setting portion at the time when the emptiness detecting portion detects that the collection container is substantially empty.

According to the aforementioned arrangement, corresponding to that an amount of waste toner particles remaining in the developing section increases as a collection amount of remaining toner by the waste toner collecting portion is set smaller, the toner collecting portion increases a collection amount of the toner particles remaining in the developing section into the collection container as a toner collection amount set by the collection amount setting portion when the emptiness detecting portion detects that the collection container is substantially empty. Accordingly, after the collection container becomes substantially empty, waste toner particles remaining in the developing section are assuredly collected into the collection container, thereby assuredly preventing a degradation of a quality of a printed image due to waste toner particles remaining in the developing section.

Further, according to the present invention, the image forming apparatus according to claim 1, wherein the toner amount detecting portion includes: a setting amount detecting portion for outputting a detection signal indicating a reach of the observing toner amount when the amount of toner particles collected into the collection container reaches the observing toner amount; and a toner amount calculating portion for calculating the collection toner amount based on the number of sheets onto which the photoconductive drum, the developing section and the transfer-fixing section performs the image forming after when the setting amount detecting portion outputs the detection signal indicating a reach of the observing toner amount.

According to the aforementioned arrangement, when the amount of toner particles collected into the collection container reaches the observing toner amount, the toner amount detecting portion outputs a detection signal indicating a reach of the observing toner amount, and the toner amount calculating portion calculates the collection toner amount based on the number of sheets onto which the photoconductive drum developing section and the transfer-fixing section performs the image forming after the setting amount detecting portion outputs the detection signal indicating a reach of the observing toner amount. Thus, there is no need to provide a detecting device for detecting a further increased amount time by time in a case where the amount of toner particles collected into the collection container exceeds the observing toner amount. Accordingly, a cost for the toner amount detecting portion can be reduced.

Further, according to the present invention, the toner amount detecting portion includes: the setting amount detecting portion for outputting a detection signal indicating a reach of the observing toner amount when the amount of toner collected in the collection container reaches the observing toner amount; and the toner amount calculating portion for calculating the collection toner amount based on the number of sheets onto which the photoconductive drum, the developing section and the transfer-fixing section performs the image forming after when the setting amount detection outputs the detection signal indicating a reach of the observing toner amount. When the toner amount detecting portion detects that the collection toner amount reaches a second observing toner amount which is greater than the observing toner amount after the receiving portion receives an operative instruction to perform the image forming operation and the image formation controller continues the image forming operation, the notifying portion notifies a user to input an instruction of whether or not continuing the image forming. In a case where the receiving portion receives an operative instruction to perform the image forming operation, the collection amount setting portion sets further reduced collection amount of toner particles remaining in the developing section into the collection container by the waste toner collecting potion, and the image formation controller performs the image forming.

According to the aforementioned arrangement, in a case where the collection toner amount detected by the toner amount detecting portion reaches the second observing toner amount which is greater than the observing toner amount, and the receiving portion receives an operative instruction to perform the image forming operation, the collection amount setting portion sets a reduced toner collection amount collected by the waste toner collecting portion, and the image formation controller performs the image forming. Accordingly, the number of sheets to be formed with images before the collection container is filled after the collection toner amount reaches the second observing toner amount can be further increased.

This application is based on Japanese Patent application serial No. 2006-052224 filed in Japan Patent Office on Feb. 28, 2006, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. An image forming apparatus comprising:

a photoconductive drum on which an electrostatic latent image is formed;

a developing section for developing the electrostatic latent image to form a toner image on the photoconductive drum, a transfer-fixing section for transferring the toner image from the photoconductive drum to a recording sheet and fixing the toner image on the recording sheet;

a waste toner particle collecting portion for collecting toner particles remaining in the developing section into a collection container;

a toner amount detecting portion for detecting a toner amount of toner particles collected in the collection container;

a notifying portion for notifying a user of a reach of a toner amount detected by the toner amount detecting portion to a predetermined observing amount; and a collection amount setting portion for setting a reduced collection amount for the collection of waste toner particles in the developing section by the waste toner collecting portion in accordance with an increase in the detected toner amount after the detected toner amount reaches the observing amount that preserves a predetermined remaining volume of the collection container to be filled.

2. The image forming apparatus according to claim 1, wherein the notifying portion notifies a user that a quality of image forming by the photoconductive drum, the developing section and the transfer-fixing section is degraded.

3. The image forming apparatus according to claim 1, wherein the notifying portion notifies a user to input an instruction of whether or not continuing an image forming operation performed by the photoconductive drum, the developing section and the transfer-fixing section; and wherein the image forming apparatus further comprises:

a receiving portion for receiving an operative instruction of whether or not performing the image forming operation when the notifying portion notifies a reach of the toner amount detected by the toner amount detection portion to the predetermined observing amount; and an image formation controller for controlling the photoconductive drum, the developing section and the transfer-fixing portion to continue the image forming operation when the receiving portion receives the instruction to perform the image forming operation.

4. The image forming apparatus according to claim 3, wherein the notifying portion notifies a user to input an instruction of whether or not continuing image forming operation performed by the photoconductive drum, the developing section and the transfer-fixing section, and also notifies that a quality of the image to be formed is degraded.

5. The image forming apparatus according to claim 3, further comprising an emptiness detecting portion for detecting that the collection container is substantially empty, wherein when the receiving portion receives an operative instruction of not performing the image forming operation, the image formation controller restricts the image forming operation until the emptiness detecting portion detects that the collection container is substantially empty.

6. An image forming apparatus comprising:

a photoconductive drum on which an electrostatic latent image is formed;

a developing section for developing the electrostatic latent image to form a toner image on the photoconductive drum, a transfer-fixing section for transferring the toner image from the photoconductive drum to a recording sheet and fixing the toner image on the recording sheet;

a waste toner particle collecting portion for collecting toner particles remaining in the developing section into a collection container;

a toner amount detecting portion for detecting a toner amount of toner particles collected in the collection container;

a notifying portion for notifying a user of a reach of a toner amount detected by the toner amount detecting portion to a predetermined observing amount;

a collection amount setting portion for setting a reduced collection amount for the collection of waste toner particles in the developing section by the waste toner collecting portion in accordance with an increase in the detected toner amount after the detected toner amount reaches the observing amount that preserves a predetermined remaining volume of the collection container to be filled;

an emptiness detecting portion for detecting that the collection container is substantially empty; and a compulsive collection processing portion for controlling the waste toner particle collecting portion to collect toner particles remaining in the developing section into the collection container when the emptiness detecting portion detects that the collection container is substantially empty in a state where the collection amount setting portion sets a reduced collection amount for the collection of waste toner particles.

7. The image forming apparatus according to claim 6, wherein when the waste toner particles collecting portion performs the compulsive collection operation, the compulsive collection processing portion increases the collection amount of waste toner particles remaining in the developing section and collected by the waste toner particles collecting portion in accordance with the collection amount of the toner particles decreased by the collection amount setting portion at the time when the emptiness detecting portion detects that the collection container is substantially empty.

8. An image forming apparatus comprising:

a photoconductive drum on which an electrostatic latent image is formed;

a developing section for developing the electrostatic latent image to form a toner image on the photoconductive drum, a transfer-fixing section for transferring the toner image from the photoconductive drum to a recording sheet and fixing the toner image on the recording sheet:

a waste toner particle collecting portion for collecting toner particles remaining in the developing section into a collection container;

a toner amount detecting portion for detecting a toner amount of toner particles collected in the collection container;

a notifying portion for notifying a user of a reach of a toner amount detected by the toner amount detecting portion to a predetermined observing amount; and a collection amount setting portion for setting a reduced collection amount for the collection of waste toner particles in the developing section by the waste toner collecting portion in accordance with an increase in the detected toner amount after the detected toner amount reaches the observing amount that preserves a predetermined remaining volume of the collection container to be filled, wherein the toner amount detecting portion includes:

a toner amount setting portion for outputting a detection signal indicating a reach of the observing toner amount when the amount of toner particles collected into the collection container reaches the observing toner amount; and a toner amount calculating portion for calculating the collection toner amount based on the number of sheets onto which the photoconductive drum, the developing section and the transfer-fixing section performs the image forming after when the toner amount setting portion outputs the detection signal indicating a reach of the observing toner amount.

9. The image forming apparatus according to claim 3, wherein the toner amount detecting portion includes:

a toner amount setting portion for outputting a detection signal indicating a reach of the observing toner amount when the amount of toner collected in the collection container reaches the observing toner amount; and a toner amount calculating portion for calculating the collection toner amount based on the number of sheets onto which the photoconductive drum, the developing section and the transfer-fixing section performs the image forming after when the toner amount setting portion outputs the detection signal indicating a reach of the observing toner amount; and wherein when the toner amount detecting portion detects that the collection toner amount reaches a second observing toner amount which is greater than the observing toner amount after the receiving portion receives an operative instruction to perform the image forming operation and the image formation controller continues the image forming operation, the notifying portion notifies a user to input an instruction of whether or not continuing the image forming; and wherein in a case where the receiving portion receives an operative instruction to perform the image forming operation, the collection amount setting portion sets further reduced collection amount of toner particles remaining in the developing section into the collection container by the waste toner collecting potion, and the image formation controller performs the image forming.

* * * * *